US006068221A

United States Patent [19]

Rosen

[11] Patent Number: 6,068,221

[45] Date of Patent: May 30, 2000

[54] FOLDING RUBBISH BAG HOLDER

[75] Inventor: Gerd Rosen, Berlin, Germany

[73] Assignee: Snappy Kunststofftechnik Fabrikations-und Vetriebsgesellschaft Innovativer Produkte mbH, Berlin, Germany

[21] Appl. No.: 09/117,847

[22] PCT Filed: Feb. 7, 1997

[86] PCT No.: PCT/DE97/00287

§ 371 Date: Aug. 6, 1998

§ 102(e) Date: Aug. 6, 1998

[87] PCT Pub. No.: WO97/29017

PCT Pub. Date: Aug. 14, 1997

[30] Foreign Application Priority Data

Feb. 9, 1996 [DE] Germany ..... 196 06 325

[51] Int. Cl.[7] ..... B60R 7/00; B65B 67/04

[52] U.S. Cl. ..... 248/99; 224/928; 224/553

[58] Field of Search ..... 248/99, 95, 101, 248/907; 224/928, 553, 563; 220/481, 708, 87.1, 480, 482

[56] References Cited

U.S. PATENT DOCUMENTS

| | | | |
|---|---|---|---|
| 2,965,344 | 12/1960 | Baker | 248/101 |
| 3,841,592 | 10/1974 | Witten | 248/101 |
| 3,870,261 | 3/1975 | McSwain | 248/101 |
| 4,537,377 | 8/1985 | Shewchuk | 248/99 |
| 4,955,566 | 9/1990 | Bolich | 248/101 |
| 5,411,192 | 5/1995 | Xiao | 224/151 |

*Primary Examiner*—Anita M. King
*Assistant Examiner*—Michael Nornberg
*Attorney, Agent, or Firm*—Cohen, Pontani, Lieberman & Pavane

[57] ABSTRACT

A folding rubbish bag holder for use in a car includes a base member having a projecting edge, a lid and an elongated connecting member hingedly connected to the base member and to the lid. The bag holder further includes a support frame having an opening for receiving a trash bag therethrough and is hingedly connected to the base member such that the support frame has a non-use position wherein said support frame is disposed along said base member and a use position wherein said support frame is pivoted substantially perpendicularly from said base member. The support frame includes at least one stop lug projecting from a top surface of the support frame and a lifting member pivotably connected to the lid for lifting the lid from the support frame and has at least one support arm for engaging the at least one stop plug on the support frame when the support frame is in the use-position. A clamping shoulder disposed at the support frame holds the support frame in the use position by engaging the projecting edge of the base member.

10 Claims, 2 Drawing Sheets

FOLDING RUBBISH BAG HOLDER

FIELD OF THE INVENTION

The invention relates to a rubbish bag holder that can be secured to any desired surface and is especially intended for use in vehicles with relatively cramped space conditions.

BACKGROUND OF THE INVENTION

In cramped space conditions, it is advantageous to attach a rubbish bag holder to a wall or similar surface, so that floor space need not be used to accommodate a container with a hanging rubbish bag. In addition, a rubbish bag holder secured to a wall surface, e.g., in a motor vehicle, is protected against overturning or slipping when the vehicle moves.

EP 0 208 680 discloses a folding rubbish bag holder mounted on a console. In this case, a rectangular folding frame, to which the rubbish bag can be attached, is equipped with a lid. With the overhanging edge of the lid, it is possible to move the lid, together with the frame, into a horizontal position. While the frame remains in this horizontal position, the lid can be moved into an open position by applying further pressure against a spring. The helical spring is mounted on a specially embodied hinge bolt, which is complicated to produce and assemble.

The design in the aforementioned EP Publication has the substantial functional disadvantage that the frame that supports the bag cannot be fixed in the horizontal position, nor can the lid be fixed in the open position. Moreover, the operating mechanism requires a folding frame of relatively great height.

SUMMARY OF THE INVENTION

The object of the invention is therefore to provide a flatly-structured rubbish bag holder, in which the frame that supports the bag can be fixed in the horizontal position and the lid can be fixed in the open state.

According to an embodiment of the present invention, the folding rubbish bag holder includes a base member having a projecting edge, a lid and an elongated connecting member hingedly connected to the base member and to the lid. The bag holder further includes a support frame having an opening for receiving a trash bag therethrough and is hingedly connected to the base member such that the support frame has a non-use position wherein said support frame is disposed along said base member and a use position wherein said support frame is pivoted substantially perpendicularly from said base member. The support frame includes at least one stop lug projecting from a top surface of the support frame and a lifting member pivotably connected to the lid for lifting the lid from the support frame and has at least one support arm for engaging the at least one stop plug on the support frame when the support frame is in the use-position. A clamping shoulder disposed at the support frame holds the support frame in the use position by engaging the projecting edge of the base member.

BRIEF DESCRIPTION OF THE DRAWINGS

The invention will be described in greater detail in reference to an embodiment shown in the drawings. In the drawings.

DETAILED DESCRIPTION OF THE PRESENTLY PREFERRED EMBODIMENT

Figure 1A:
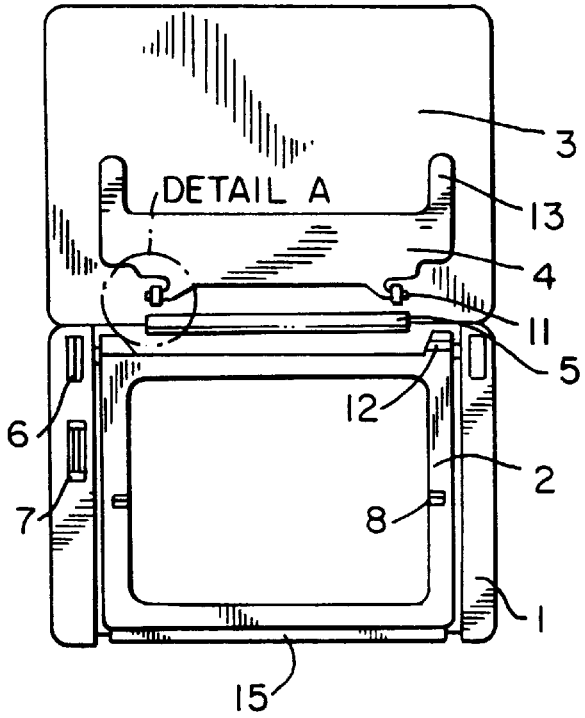
FIG. 1A is a front view of the rubbish bag holder constructed in accordance with an embodiment of the present invention.

On a frame-like base member 1, with which the bag holder can be secured to any desired surface by screwing or gluing, a support frame 2 is arranged in pivotable fashion by means of pivot pins. A first pivot pin of the support frame 2 is mounted in a hole of a springing holding element 6 arranged to the side of the support frame 2. Pressure on an operating button 7 causes the first pivot pin to slide out of its hole. By means of lateral movement, which slides the second pivot pin out of its hole, the support frame 2 can be removed from the base member 1. A bag frame 14 can be placed into the support frame 2, which is open on one side. The bag frame 14 is locked into the support frame 2 by means of projections attached to the two frames 2, 14. With the bag frame 14, the rubbish bag is attached to the support frame 2.

Figure 2A:
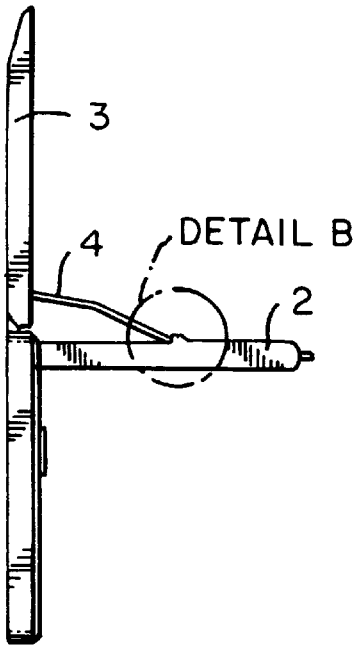
FIG. 2A is a side view of the embodiment of FIG. 1A.
Figure 1B:
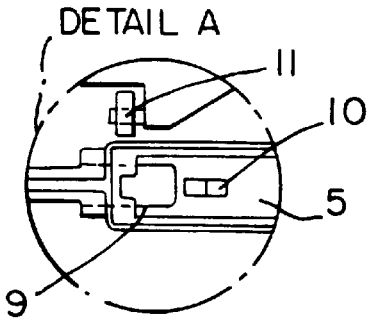
FIG. 1B is an enlarged view of detail A of FIG. 1A.
Figure 2B:
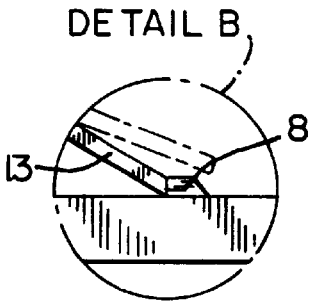
FIG. 2B is an enlarged view of detail B of FIG. 2A.
Figure 3:
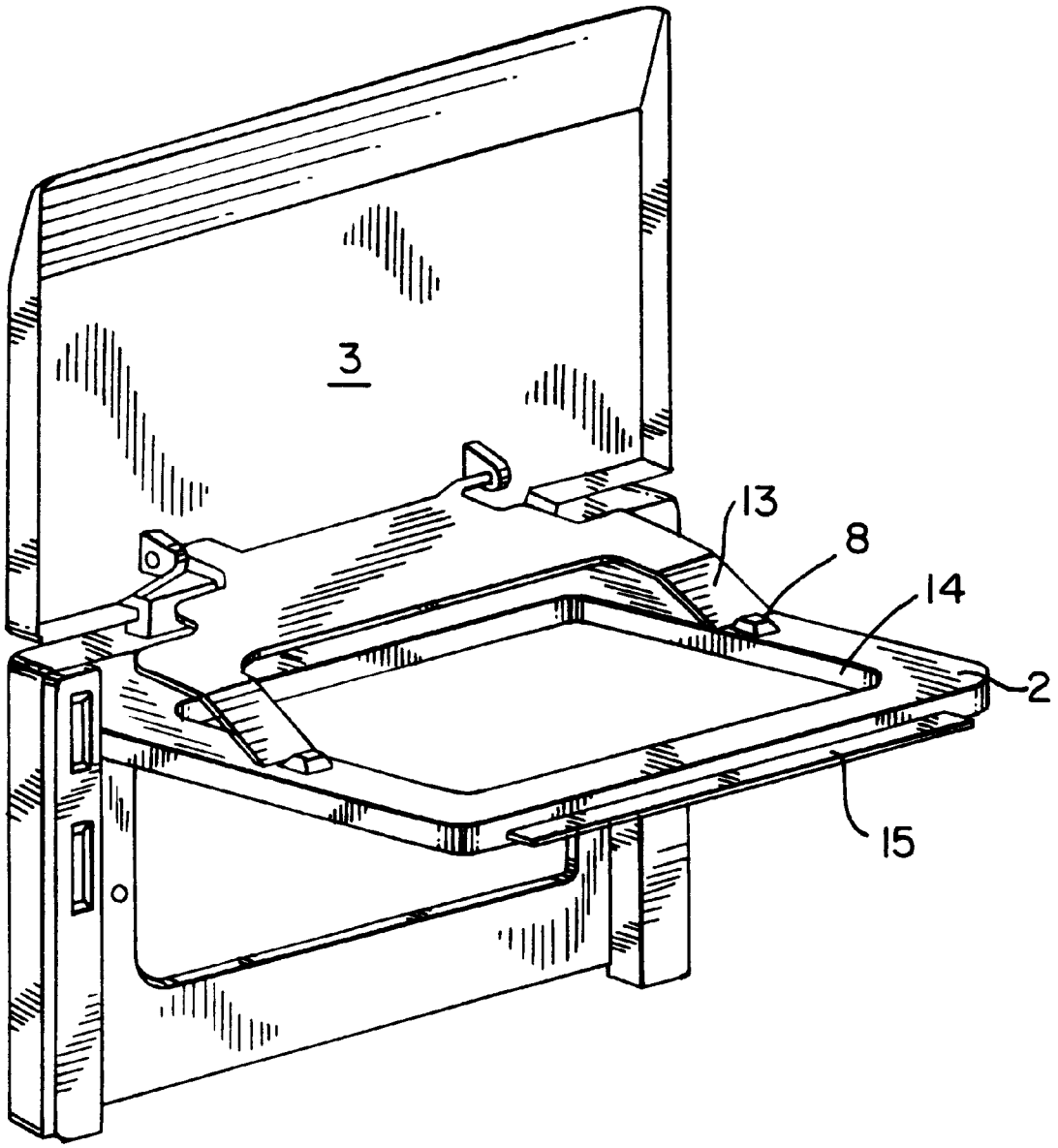
FIG. 3 is a perspective view of the embodiment of FIG. 1A.

When the rubbish bag is not in use, the support frame 2 and the lid 3 are in a folded state. Lifting the support frame 2 by a frame projection 15 causes the support frame 2 to move into the horizontal position for use (FIGS. 2 and 3). In this position, clamping shoulders 12 on the support frame 2 move under an edge projection of the base member 1 and hold the support frame 2 in the horizontal use position.

Even before the opened support frame 2 reaches the horizontal position, a lifting member 4, which is mounted pivotally on the lid 3 by means of pivot joints 11, begins to lift the lid 3 from the support frame 2. Laterally-projecting support arms 13 on the lifting part 4 thereby rest upon vertical surfaces of stop lugs 8 arranged on the sides of the support frame 2.

When the support frame is in the horizontal position, the lid is completely opened and rubbish can conveniently be placed into the rubbish bag.

The base part 1 is connected to the lid 3 via a connecting part 5 (which is elongated in the edge direction of the parts 1, 3) by means of a double rotary bearing. The connecting part 5 is thus connected in hinged fashion to the base member 1 as well as to the lid 3.

The connecting member 5, which has a U-shaped cross-section, is equipped with lateral walls, through which the legs of a U-shaped wire clamp 9 (Detail A) run on each side of the connecting member 5. The ends of the legs of the clamp 9 are inserted into the holes in the base part 1 and the lid 3, and thereby form rotary journals for the described double rotary bearing. The clamp 9 are prevented by lugs 10 molded on the connecting member 5 from sliding out of the through holes and insertion holes.

Because of the described double rotary bearing between the base member 1 and the lid 3, it is possible, when the lid 3 is about to be folded onto the support frame 2 (located in the use position), for the connecting member 5 to initially fold somewhat in the direction of the support frame 2. As a result, the support arms 13 of the lifting member 4, which, while the lid 3 was in the open state, have been suspended over the stop lugs 8, due to the resting of the lifting member 4 on the upper edge of the connecting part 5, do not return behind the stop lugs 8, but instead slide past the stop lugs 8 (see broken-line depiction in Detail B). It is thus possible to fold the lid into the horizontal position, i.e., to close the rubbish bag.

When the rubbish bag holder is not in use, the lid 3 and the support frame 2 are folded downward, and the lid 3 can be arrested by means of latching projections on the base member 1.

What is claimed is:

1. A folding rubbish bag holder comprising:

a base member having a projecting edge;

a lid;

an elongated connecting member hingedly connected to the base member and to the lid;

a support frame having an opening for receiving a trash bag therethrough and hingedly connected to the base member such that the support frame has a non-use position wherein said support frame is disposed along said base member and a use position wherein said support frame is pivoted substantially perpendicularly from said base member, the support frame including at least one stop lug projecting from a top surface of the support frame;

a lifting member pivotably connected to the lid for lifting the lid from the support frame and having at least one support arm for engaging the at least one stop lug on the support frame when the support frame is in the use-position; and a clamping shoulder disposed at the support frame for holding the support frame in the use position by engaging the projecting edge of the base member.

2. The rubbish bag holder of claim 1, further comprising:

a holding member disposed in an end region of the support frame;

an operating button disposed in a central region of the support frame; and a pin extending from the support frame to engage the holding member so as to releasably attach the support frame to the base member.

3. The rubbish bag holder of claim 1, wherein the elongated connecting member has a cavity, a U-shaped cross-section, and closed side walls.

4. The rubbish bag holder of claim 1, wherein the elongated connecting member includes:

a U-shaped clamp comprising a wire and disposed at each axial end of the elongated connecting member, the U-shaped clamp having a pair of legs extending axially outwardly, each of the legs being configured for slidable receipt in corresponding holes defined in the lid and in the base member; and a lug disposed proximate each of the U-shaped clamps for retaining said each of the U-shaped clamps.

5. The rubbish bag holder of claim 1, further comprising a bag frame disposed in the opening of the support frame.

6. The rubbish bag holder for claim 5, wherein the support frame has an inside wall and includes at least one projection extending from said inside wall and toward the bag frame, and the bag frame includes at least one complementary projection configured for latching engagement with the at least one projection of the support frame.

7. The rubbish bag holder of claim 6, wherein the at least one projection of the support frame has a rectangular cross-section and the at least one complementary projection of the bag frame has a lug profile.

8. The rubbish bag holder of claim 1, further including means for latching the lid with the base member.

9. The rubbish bag holder of claim 5, wherein the base member, the lid, the elongated connecting member, the support frame, the bag frame, the lifting member, and the clamping shoulder are made of plastic.

10. The rubbish bag holder of claim 1, wherein the lifting member is made of metal, and the base member, the lid, the elongated connecting member, the support frame, the bag frame, and the clamping shoulder are made of plastic.

* * * * *